US006685445B2

(12) United States Patent
Wu

(10) Patent No.: US 6,685,445 B2
(45) Date of Patent: Feb. 3, 2004

(54) STRUCTURE OF A VERTICAL-TYPE, ACID AND BASE RESISTANCE PUMP

(76) Inventor: Huang-Chang Wu, PO Box 82-144, Taipei (TW)

( * ) Notice: Subject to any disclaimer, the term of this patent is extended or adjusted under 35 U.S.C. 154(b) by 159 days.

(21) Appl. No.: 09/956,222

(22) Filed: Sep. 20, 2001

(65) Prior Publication Data

US 2003/0053919 A1 Mar. 20, 2003

(51) Int. Cl.[7] ..... F04B 17/00
(52) U.S. Cl. ..... 417/423.11; 415/196
(58) Field of Search ..... 417/423.11, 423.14, 417/424.1; 415/196, 214.1, 197, 217.1, 200, 189

(56) References Cited

U.S. PATENT DOCUMENTS 6,074,166 A * 6/2000 Moddemeijer ..... 415/109

* cited by examiner

*Primary Examiner*—Teresa Walberg
*Assistant Examiner*—Vinod D. Patel

(57) ABSTRACT

An improved structure of a vertical-type, acid and base resistance pump is disclosed. The present pump structure comprises a motor, a seal cap, a ceramic ring, two seals, a shaft cap, a propeller wheel and a pump body, the front of the motor provided with a shaft center having mounted with the shaft cap to prevent fluid from entering and to engage with the propeller wheel, the external side of the shaft center provided with the pump body having an outlet tube, the seal cap located between the top section of the body and the motor, and the bottom section of the body mounted with the ceramic ring, characterized in that the positive face and the reverse face of the shaft cap are provided with the high abrasive resistance seals, and the two seals contact at the top and bottom of the ceramic ring, such that the heat energy is dissipated from the seal cap to outside, and gas is prevented from entering and the reverse-flow of fluid is prevented.

1 Claim, 4 Drawing Sheets

STRUCTURE OF A VERTICAL-TYPE, ACID AND BASE RESISTANCE PUMP

BACKGROUND OF THE INVENTION (a) Field of the Invention

The present invention relates to an improved structure of a vertical-type acid and base resistance pump, and in particular, a pump having a shaft cap mounted with seals contacting with the ceramic ring mounted to the pump.

(b) Description of the Prior Art

FIGS. 1 and 2 show a conventional pump essentially comprising a motor 10, a seal cap 2, a shaft cap 3, a seal 31, a body 4, a propelled wheel 32, an outlet tube 41. The front section 10 is mounted with a shaft center 1 and the external of the shaft center 1 is provided with the body 4. The bottom of the body 4 is provided with the outlet tube 41 allowing fluid to enter and leave the pump. The shaft center 1 is mounted with the shaft cap 3 and the bottom thereof is connected to the propeller wheel 32 having tubular shape front.

The front section of the motor 10 and the top section of the body 4 are provided with the seal cap 2. The interior of the seal cap 2 is ejection molded to form a ceramic ring 21. The seal 3 located at the bottom of the ceramic ring 21 is provided with a dry-type seal 31. If the pump is not in operation, the seal 31 moves upward and in contact with the bottom of the ceramic ring 21 at the seal cap 2. When the pump is in operation, the centrifugal force causes the moving plate of the seal 31, which in contact with the bottom of the ceramic ring 21 at the side thereof is disengaged. Due to the poor design of the seal, only when pump is not running, acidic gas can be prevented from entering the pump (as shown in FIG. 3), but the pressure of the reverse flow of the fluid cannot be prevented. In this conventional structure, when the shaft center 1 of the motor rotates, (the suction of vacuum show in FIG. 4), the external air will enter the pump through the slit (as shown by the arrows) between the shaft cap 3 and the pump 4 of the motor 10 as a result of vacuum suction and the rotation of the motor 10, such that the vacuum provided by the pump is greatly reduced. Due to the insufficient of the vacuum, and there is only one seal 31 with the moving plate, the sealing is insufficient and it cannot withstand the pressure caused by the reverse flow of the corrosive fluid.

Further, the leakage proof is insufficient (refer to FIG. 3). to withstand the prolong abrasion of the ceramic ring 21 with the seal 31, When the pump is not in operation, the fluid at the outlet tube 41 will overflow the seal 31 which Other damages the seal at the front cover of the motor. In addition, the fluid, that overflow will pollute the environment. Accordingly, it is an object to provide an improved structure of a vertical-type, acid and base resistance pump wherein the above drawbacks such as poor vacuum and fluid overflow, can be overcome.

SUMMARY OF THE INVENTION

Accordingly, it is an object of the present invention is to provide an improved structure of a vertical-type, acid and base resistance pump, which mitigates the drawbacks of the conventional structure of a pump.

Yet another object of the present invention is to provide an improved structure of a vertical-type, acid and base resistance pump, wherein the pump is acid and base resistance, and gas is prevented from entering into the pump, and fluid is prevented from reverse-flowing into the pump, thereby vacuum within the pump is improved.

A further object of the present invention is to provide an improved structure of a vertical-type, acid and base resistance pump, wherein the pump is avoided from contamination and the motor of the pump is prevented from damaging, and thereby the longevity of the pump is prolonged.

An aspect of the present invention is to provide an improved structure of a pump comprising a motor, a seal cap, a ceramic ring, two seals, a shaft cap, a propeller wheel and a pump body, the front of the motor provided with a shaft center having mounted with the shaft cap to prevent fluid from entering the pump and to engage with the propeller wheel, the external side of the shaft center provided with the pump body having an outlet tube, the seal cap located between the top section of the body and the motor, and the bottom section of the body mounted with the ceramic ring, characterized in that the positive face and the reverse face of the shaft cap are provided with the high abrasive resistance seals, and the two seals are in contact at the top and bottom of the ceramic ring such that gases will not be absorbed by the pump, and no overflow of fluid in the course of shutting down or starting-up of pump.

Other object and advantages of the present invention will become more apparent from the following description taken in conjunction with the accompanying drawing.

DETAILED DESCRIPTION OF THE PRESENT INVENTION

Figure 1:
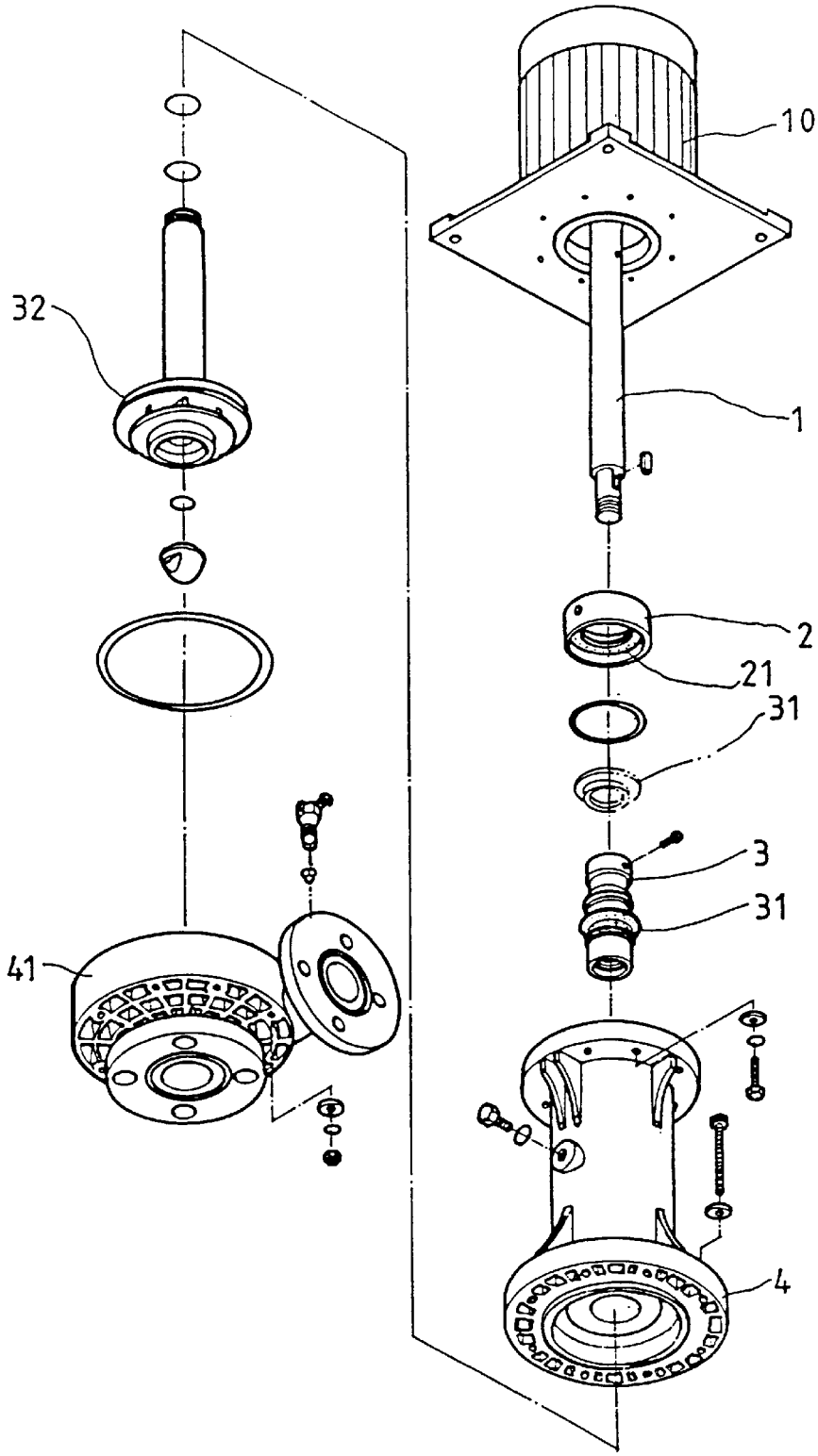
PRIOR ART FIG. 1
FIG. 1 is a perspective exploded view of a conventional pump system
Figure 2:
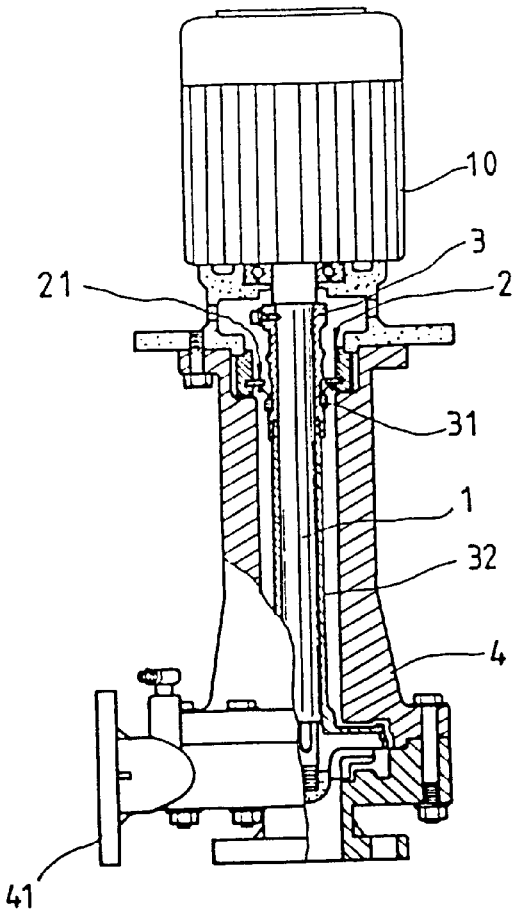
PRIOR ART FIG. 2
FIG. 2 is a sectional view of a conventional pump system.
Figure 3:
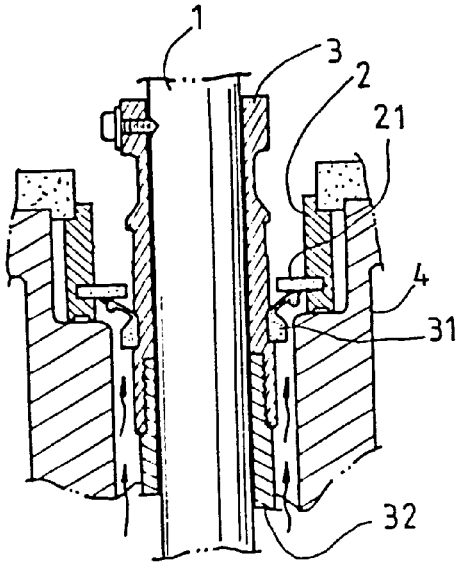
PRIOR ART FIG. 3
FIG. 3 is a partial enlarged view of the conventional pump system.
Figure 4:
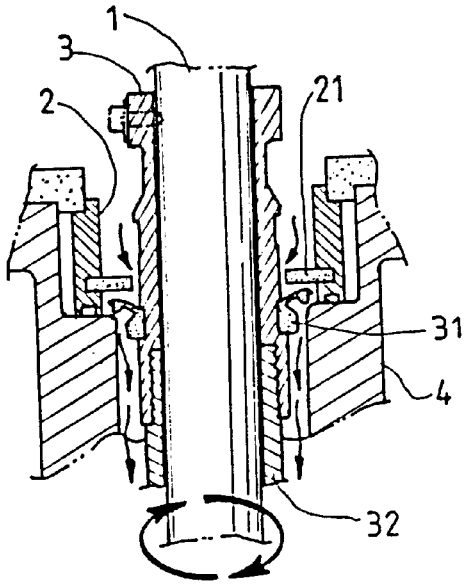
PRIOR ART FIG. 4
FIG. 4 is the pump suction region of the conventional pump system
Figure 5:
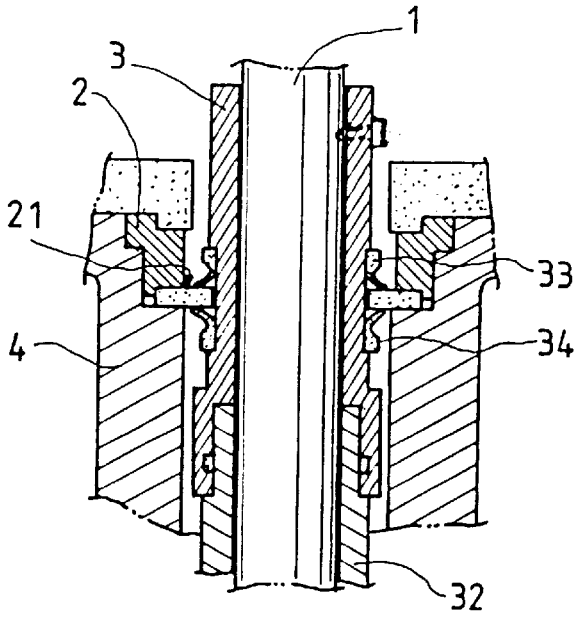
FIG. 5 is a partial enlarged of the pump structure of the present invention.
Figure 6:
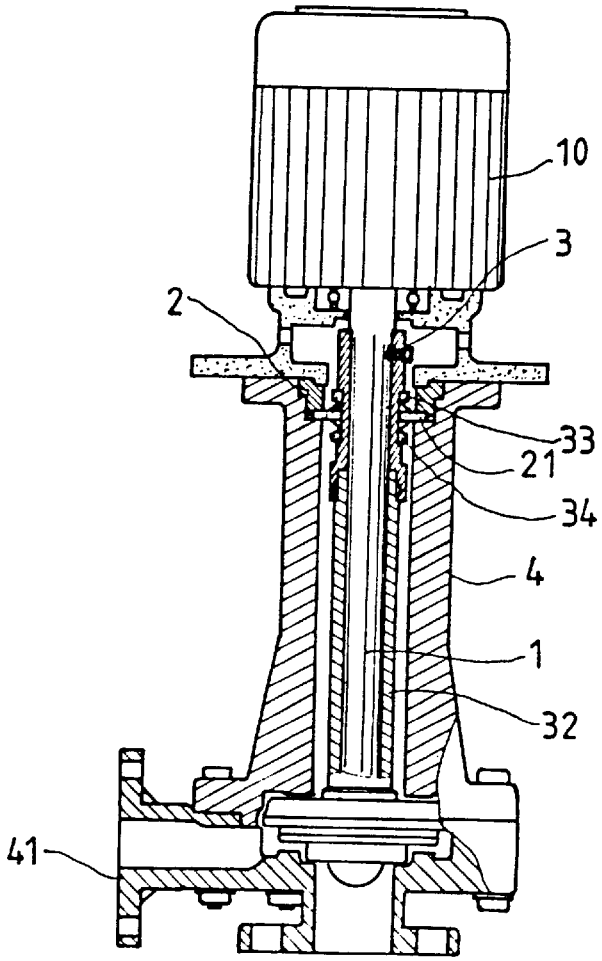
FIG. 6 is sectional view showing the pump structure of the present invention.
Figure 7:
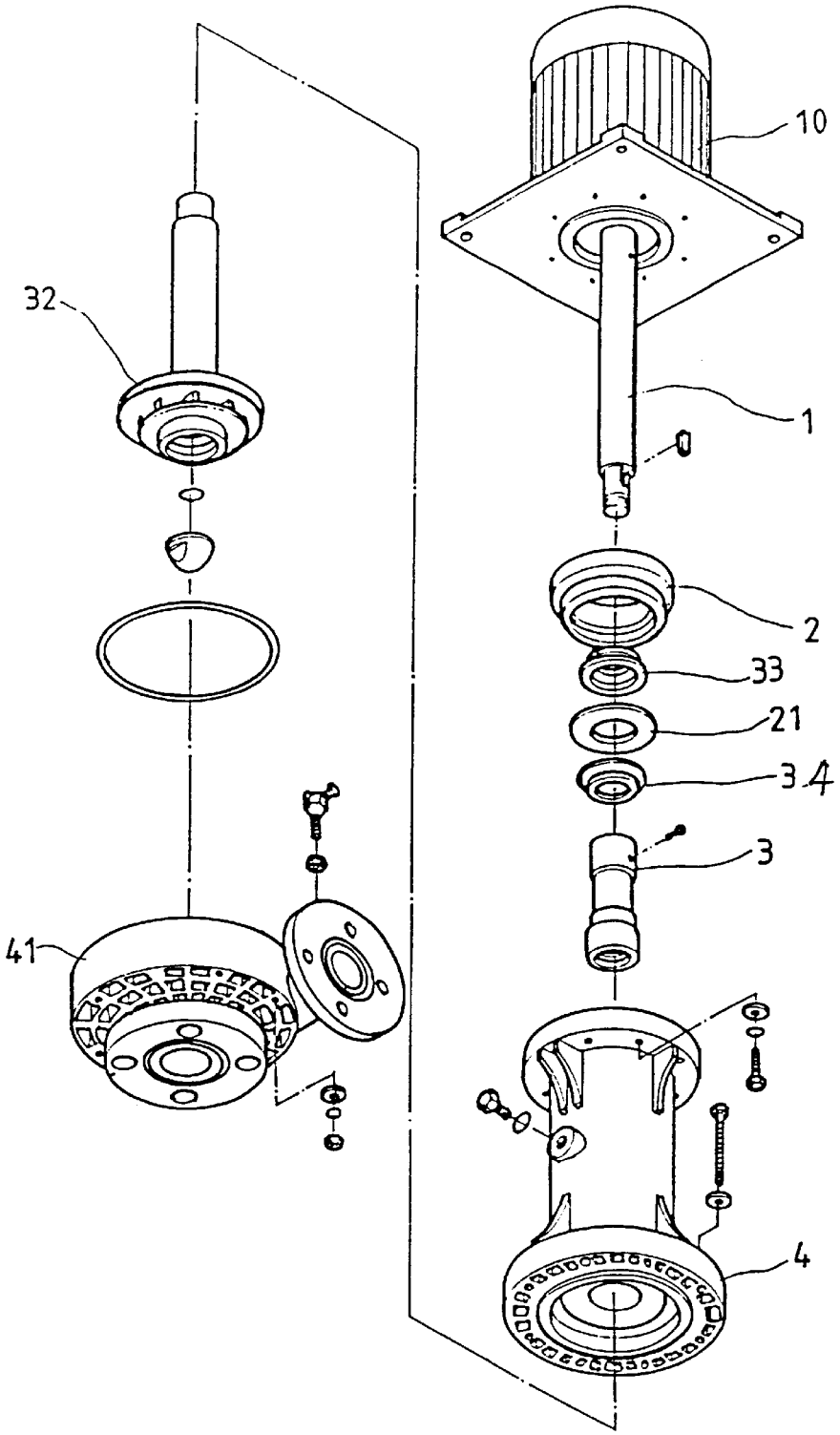
FIG. 7 is a perspective exploded view of the present invention.

Referring to FIGS. 5, 6 and 7, there are a partial enlarged sectional view, a sectional view and an exploded perspective view of a vertical-type, acid and base resistance pump structure in accordance with the present invention. The pump comprises a motor 10, a seal cap 2, a ceramic ring 21, two seals 33, 34, a shaft cap 3, a propeller wheel 32, and a body 4. The front section of the motor 10 is provided with a long shaft center 1, and in order to protect the shaft center 1 from the entering of corrosive fluid, the shaft cap 3 is tightly sealed to the shaft center 1, and the lower end of the shaft cap 3 and the tubular section of the propeller wheel 32 are mounted as one unit. The exterior of the shaft center 1 is mounted with the body 4. The bottom section of the body 4 is provided with an outlet tube 41.

In accordance with the present invention, in order to prevent external gas from entering the pump so as to improve the vacuum of the pump, a seal cap 2 is mounted between the motor 10 and the top section of the body 4. The bottom section of the seal cap 2 is provided with a large size, and thick ceramic ring 21. In accordance with the present invention, in order to prevent external gas from entering the pump so as to improve the vacuum of the pump, and to mitigate the drawback of the conventional vertical-type pump which absorbs gas, the shaft cap 3 is mounted with seals 33, 34 at the positive face and the reverse face of the shaft cap 3. The material of the seals 33, 34 is high abrasive resistance material. The two seals 33, 34 are symmetrical in a top and bottom position and are mounted onto the ceramic ring 21.

In operation, the two faces of the dry-type seals 33, 34 will contact and abrade with the top and bottom face of the ceramic ring 21. The heat produced by such abrasion will be dissipated from the ceramic ring 21 and the seal cap 2 to the external air. As the seals 33, 34 located at the top and bottom of the ceramic ring 21 are of larger size, the ceramic ring 21 is always in contact and in abrasion relation. In other words, whether when the pump is shut-off or is running, the sealing of the ceramic ring 21 is complete and the external air will not enter the pump by means of vacuum suction or the pressure as a result of pump operation. This is because the mounting of the two dry-type seals 33, 34 prevents air from entering the pump. Thus the pump has improved the vacuum condition and the working efficiency is upgraded. Furthermore, other than acid and base are prevented from moving upward, when the pump is not running, the corrosive fluid in the outlet tube 41 will not reach the seals 33, 34 and the ceramic ring 21 to produce overflow. Thus, no leakage or overflow of the corrosive fluid occurred and naturally the seal of the motor 10 will not be damaged, and the environment will not be polluted.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A structure of a pump comprising a motor, a seal cap, a ceramic ring, two seals, a shaft cap, a propeller wheel and a pump body, the front of the motor provided with a shaft center having mounted with the shaft cap to prevent fluid from entering the pump and to engage with the propeller wheel, the external side of the shaft center provided with the pump body having an outlet tube, the seal cap located between the top section of the body and the motor, and the bottom section of the body mounted with the ceramic ring, characterized in that the positive face and the reverse face of the shaft cap are provided with the high abrasive resistance seals, and the two seals contact at the top and bottom of the ceramic ring such that gases will not be absorbed by the pump, and no overflow of fluid in the course of shutting down or starting-up the pump, wherein the two shaft caps are symmetrical in a top and bottom position.

* * * * *